US006187521B1

(12) United States Patent
Wang et al.

(10) Patent No.: US 6,187,521 B1
(45) Date of Patent: Feb. 13, 2001

(54) IMAGING ELEMENTS

(75) Inventors: Yongcai Wang, Penfield; Janglin Chen, Rochester; Dwight W. Schwark, Rochester; James L. Bello, Rochester, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/221,470

(22) Filed: Dec. 28, 1998

(51) Int. Cl.[7] ..... G03C 1/76; G03C 1/795; G03C 1/815; G03C 1/89

(52) U.S. Cl. ..... 430/512; 430/510; 430/517; 430/523; 430/527; 430/529; 430/530; 430/531; 430/533; 430/536; 430/950; 430/961

(58) Field of Search ..... 430/523, 527–531, 430/533, 536, 950, 961, 510, 517, 512

(56) References Cited

U.S. PATENT DOCUMENTS

| | | | |
|---|---|---|---|
| 4,203,769 | 5/1980 | Guestaux | 430/631 |
| 4,612,279 | 9/1986 | Steklenski et al. | 430/536 |
| 4,735,976 | 4/1988 | Steklenski et al. | 524/32 |
| 4,766,059 | 8/1988 | Vandenabeele et al. | 430/523 |
| 5,695,919 | 12/1997 | Wang et al. | 430/536 |

FOREIGN PATENT DOCUMENTS

| | | |
|---|---|---|
| 0 886 176 | 12/1998 | (EP) . |

*Primary Examiner*—Richard L. Schilling
(74) *Attorney, Agent, or Firm*—Doreen M. Wells

(57) ABSTRACT

The present invention is an imaging element which includes a support, an image forming layer superposed on the support; and at least one layer superposed on the support. The at least one layer superposed on the support is formed from a non-aqueous coating composition of a composite wax particle composed of a wax phase and a non-crosslinked polymer phase and an organic solvent. The wax phase includes a wax having a melting point of greater than 30° C. The wax comprises greater than 80% by weight of the wax phase. The wax phase to non-crosslinked polymer phase ratio is greater than 30/70 and less than 90/10.

11 Claims, No Drawings

IMAGING ELEMENTS

CROSS REFERENCE TO RELATED APPLICATIONS

This application relates to commonly assigned application Ser. No. 09/221,639 now U.S. Pat. No. 6,048,679, filed simultaneously herewith. This application relates to commonly assigned application Ser. No. 09/221,469 pending, filed simultaneously herewith. This application relates to commonly assigned application Ser. No. 09/221,083 now U.S. Pat. No. 6,075,090, filed simultaneously herewith. This application relates to commonly assigned application Ser. No. 09/221,465 now U.S. Pat. No. 6,048,677, filed simultaneously herewith. This application relates to commonly assigned copending application Ser. No. 09/221,776 pending, filed simultaneously herewith. This application relates to commonly assigned copending application Ser. No. 09/221,883 pending, filed simultaneously herewith. This application relates to commonly assigned application Ser. No. 09/221,516 now U.S. Pat. No. 6,048,678, filed simultaneously herewith. These copending applications are incorporated by reference herein. These copending applications are incorporated by reference herein.

FIELD OF THE INVENTION

This invention relates in general to imaging elements such as, for example, photographic elements and in particular to imaging elements comprising a support, an image-forming layer and one or more auxiliary layers. More specifically, this invention relates to such imaging elements that have at least one layer comprising a composite wax particle.

BACKGROUND OF THE INVENTION

The imaging elements to which this invention relates can be of many different types depending on the particular use for which they are intended. Such elements include, for example, photographic, electrophotographic, electrostatographic, photothermographic, migration, electrothermographic, dielectric recording, inkjet ink image recording and thermal-dye-transfer imaging elements.

Layers of imaging elements other than the image-forming layer are commonly referred to as auxiliary layers. There are many different types of auxiliary layers such as, for example, subbing layers, backing layers, interlayers, overcoat layers, receiving layers, stripping layers, antistatic layers, transparent magnetic layers, and the like.

Support materials for an imaging element often employ auxiliary layers comprising glassy, hydrophobic polymers such as polyacrylates, polymethacrylates, polystyrenes, or cellulose esters, for example. One typical application for such an auxiliary layer is as a backing layer to provide resistance to abrasion, scratching, blocking, and ferrotyping. Such backing layers may be applied directly onto the support material, applied onto a priming or "subbing" layer, or applied as an overcoat for an underlying layer such as an antistatic layer, transparent magnetic layer, or the like. For example, U.S. Pat. No. 4,203,769 describes a vanadium pentoxide-containing antistatic layer that is overcoated with a cellulosic layer applied from an organic solvent. U.S. Pat. Nos. 4,612,279 and 4,735,976 describe organic solvent-applied layers comprising a blend of cellulose nitrate and a copolymer containing acrylic acid or methacrylic acid that serve as overcoats for antistatic layers.

Frequently, when the auxiliary layer serves as the outermost layer, as is the case for a backing layer, it is desirable for this layer to have a low coefficient of friction (COF) to provide proper conveyance properties and to protect the imaging element from mechanical damage during the manufacturing process or customer use. It is known to protect imaging elements against mechanical damage by coating them with a layer comprising a lubricant such as a wax. However, it has proven difficult to provide a single layer applied from organic medium that comprises both an abrasion-resistant polymer and a lubricant since it is difficult to find a coating medium that dissolves both the polymer and the lubricant and is at the same time attractive from an environmental and health standpoint. In addition, it is difficult to form a stable dispersion of a lubricant such as a wax in an organic medium that may be added to a coating composition containing a dissolved, abrasion-resistant polymer. Therefore, in order to form a backing layer which can be applied from liquid organic medium that is both abrasion-resistant and has a low coefficient of friction one often applies two separate layers; a first layer which is comprised of an abrasion-resistant polymer and then a second layer which is comprised of a lubricant such as a wax. The need to apply these two separate layers increases both manufacturing complexity and cost.

U.S. Pat. No. 4,766,059 describes a method of making solid spherical beads having a mean size ranging form 0.5 to about 20 $\mu$m. The polymer beads contain a polymeric resinous material and a water insoluble wax. The process of making such solid beads involves the use of water miscible or immiscible low boiling solvent to dissolve both polymeric materials and wax, and subsequently removal of the solvent or solvent mixture by evaporation. This requires large processing equipment and lengthy processing time, which increases the cost of such material. U.S. Pat. No. 5,695,919 describes a lubricant impregnated core/shell polymer particle, the polymer particle comprising a core portion which is insoluble in the organic medium and a shell portion which has an affinity for both the core portion and the organic medium.

The objective of this invention is to provide an imaging element with a wax particle composition which, when used in a surface layer, for example, provides the imaging element with superior surface characteristics.

SUMMARY OF THE INVENTION

The present invention is an imaging element which includes a support, an image forming layer superposed on the support; and at least one layer superposed on the support. The at least one layer superposed on the support is formed from a non-aqueous coating composition of a composite wax particle composed of a wax phase and a non-crosslinked polymer phase and an organic solvent. The wax phase includes a wax having a melting point of greater than 30° C. The wax comprises greater than 80% by weight of the wax phase. The wax phase to non-crosslinked polymer phase ratio is greater than 30/70 and less than 90/10.

DETAILED DESCRIPTION OF THE INVENTION

The imaging elements of this invention can be of many different types depending on the particular use for which they are intended. Details with respect to the composition and function of a wide variety of different imaging elements are provided in U.S. Pat. No. 5,300,676 and references described therein.

Photographic elements can comprise various polymeric films, papers, glass, and the like, but both acetate and polyester supports well known in the art are preferred. The thickness of the support is not critical. Support thickness of 2 to 10 mil (0.06 to 0.30 millimeters) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

In accordance with the invention, the imaging elements have at least one layer formed from a non-aqueous coating composition comprising a composite wax particle having a wax phase and a non-crosslinked polymer phase. The wax phase is composed of greater than 90% by weight of a wax having a melting point of greater than 30° C. The wax phase to non-crosslinked polymer phase ratio is greater than 30/70 and less than 90/10. The wax phase is preferably insoluble in the solvent medium.

Wax useful for the practice of the invention has been described, for example, in references such as "The Chemistry and Technology of Waxes", A. H. Warth, $2^{nd}$ Ed., Reinhold Publishing Corporation, New York, N.Y. 1956, and "Plastics Additives and Modifiers Handbook", Chapter 54–59, J. Ederibaum (Ed.), Van Nostrand Reinhold, New York, N.Y. 1992. Suitable waxes include hydrocarbon and/or ester-containing waxes, e. g. animal waxes such as beewax, plant waxes such as carnauba wax, paraffin waxes, microcrystalline waxes, Fischer-Torpsch waxes, polyethylene waxes, polypropylene waxes, and a mixture thereof.

The composite wax particle of the present invention is preferably prepared by polymerizing a vinyl monomer or a monomer mixture in the presence of pre-formed aqueous wax particles. Pre-formed aqueous wax dispersion (or emulsion) is primarily composed of wax particles, dispersants/surfactants, and water. The dispersants can be nonionic, anionic, and cationic, and can be polymeric and are used at levels as high as 20% of the wax. Wax particles can be formed by various methods known in the art. For example, they can be prepared by pulverizing and classifying dry waxes or by spray drying of a solution containing waxes followed by redispersing the resultant particles in water using a dispersant; they can be prepared by a suspension technique which consists of dissolving a wax in, for example, a water immiscible solvent, dispersing the solution as fine liquid droplets in aqueous solution, and removing the solvent by evaporation or other suitable techniques; they can be prepared by mechanically grinding a wax material in water to a desired particle size in the presence a dispersant, heating the wax particles dispersed in water to above their melting point, and cooling the melted particles in water to form a stable wax emulsion.

In the present invention, the pre-formed aqueous wax dispersions are formed by the so-called "atmospheric emulsification" and "pressure emulsification" techniques. The atmospheric process is used to prepare wax dispersions for waxes with melting points below the boiling point of water. The process typically consists of melting wax and surfactant together, and optionally a base is added to the melt. Hot water is then slowly added to the wax melt with vigorous agitation (water to wax). Wax emulsion can also be formed by adding molten wax/surfactant blend to boiling water with vigorous agitation. Pressure emulsification is generally needed for wax with melting points greater than 100° C. It is similar to the process described above except at temperatures above the water boiling point. Vessels capable of withstanding high pressures are normally used.

Ethylenically unsaturated monomers which may be used to prepare the polymer phase of the composite wax particles of the present invention may include acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, acrylamide and methacrylamide. Other monomers which may be used, either alone or in admixture with these acrylic monomers, include vinyl acetate, poly(ethylene glycol) (meth)acrylates, N-vinyl-2-pyrrolidone, vinylimidazole, vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene malonates, isoprene, and butadiene. The polymerization reaction involved in the present invention is initiated and maintained with an initiating agent or catalyst, which is very similar to those used in conventional emulsion polymerization. Most useful catalysts for the practice of the present invention are azo, diazo, and peroxide compounds, for example, benzoyl peroxide, azobisisobytyronitrile and azobiscyanovaleric acid. The amount of the initiators employed follows generally the practice in a conventional emulsion polymerization. In general, the amounts can vary within the range of about 0.2 to 3 or 4 weight % or possibly higher by weight of the total monomers. It is generally recognized that a high level of initiators tends to result in lowered molecular weights for the ultimate polymers. If the polymerization is carried out in multiple stages, the amount of initiators in the beginning or initiating stage are adjusted to match the proportion of the monomer then present, and further initiators are fed during the delayed feed stage to correspond to the delayed feed of the monomers. In any case, the initiators are supplied as needed to maintain the reaction in smooth and easily controlled conditions. Surfactants that can be used in the present invention include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Chain transfer agents may also be used to control the properties of the polymer particles formed.

Generally speaking, the reaction conditions employed in the execution of the present method parallel those utilized in conventional emulsion polymerization as regards such variables as temperature, time, agitation, equipment, etc. The reaction temperature can be maintained at a constant value or can vary from 50 to 80 or 90° C. If the reaction temperature varies, the starting temperature is usually around 50 to 55° C., and as the reaction proceeds exothermically, the temperature rises.

The time of the reaction is difficult to predict since it will depend upon other variables, such as the amount of initiating agent introduced, the reaction temperature, etc. If the amount of monomer is small, the reaction may be finished within about an hour but with larger amounts the reaction will usually continue for 3 to 4 hours. About ½ to 1 hour of post-heating stage after all monomer has been added can be used to insure that the polymerization has gone to completion and no free monomer is present. The sequence of addition of the various ingredients is not critical and can be varied. Usually, aqueous medium is first added to the reactor, then aqueous wax dispersion, and monomer in that order, all being added while the medium is thoroughly agitated, followed by the initiators, but other sequences are possible.

In one of the preferred embodiments of the invention, the involves polymerization process in the presence of preformed aqueous wax particles is carried out sequentially (see, for example, Padget, J. C. in Journal of Coating Technology, Vol 66, No. 839, pages 89 to 105, 1994). In this process, the polymerization is conducted in a monomer-starved manner.

The copolymer contained in the composite wax particles of the invention is properly designed to have good "bonding" with the wax phase and good compatibility in the solvent medium. Defining compatibility of the copolymer in the solvent medium can be achieved by using the concept of "polymer solubility map" (see, for example, Ramsbothan, J. in Progress in Organic Coatings, Vol 8, pages 113–141, 1980; and Wicks, Jr. Z. W., Jones, F. N., and Papas, S. P. in Organic Coatings, pages 229–239, 1992, John Wiley & Sons, Inc.). As the organic Solvents, any of the solvents customarily used in coating compositions may be satisfactorily used.

Since the polymer contained in the composite wax particle of the invention must be soluble in the non-aqueous medium it is necessary that the polymer is firmly bound either physically or chemically to the wax phase. Otherwise the polymer may be dissolved away from the wax phase and the composite wax particles would lose its stability. Chemical bonding can be achieved by grafting of the polymer to the wax phase. One of the mechanisms may involve abstraction of hydrogen from the wax molecule by free radical present in the system, giving active centers onto which the polymer chain may grow.

Although the polymer phase consisting of non-crosslinked polymers, the polymers may carry in addition to the polymerizable group a chemically functional group wherein the non-crosslinked polymers are rendered crosslinkable by an external crosslinking agent and can be crosslinked after the application to s substrate of a coating compostion into which the composite wax particles are incorporated.

The composite wax particles of the invention may be incorporated directly into a coating composition, the main film forming constituent of which is compatible with the composite wax particles. Alternatively, the composite wax particles may be first isolated from the aqueous dispersion, for example, by spray drying, and then be incorporated into a liquid coating composition as a dry powder. As a further alternative, the composite wax particles thus isolated may be blended into a powder coating composition.

As the organic solvent, any of the members customarily used in coating compositions may be satisfactorily used. However, the preferred solvents for the practice of the present invention may include, for example, acetone, methyl ethyl ketone, methanol, ethanol, butanol, dowanol PM, iso-propanol, propanol, toluene, xylene, methyl isobutyl ketone, methylene chloride, propyl acetate, and the mixture thereof.

A wide variety of materials can be used together with the composite wax particles to prepare the image element of the invention. Preferred binders are polymeric and include, for example, polyesters, polyamides, polyurethanes, cellulose derivatives, polyacrylates, polycarbonates, polyvinyl acetate, polyvinyl butyral, polyvinyl acetal, polystyrene, styrene-butadiene copolymers, epoxy resins, melamine resins, phenolic resins, vinylidene fluoride-containing polymers, and the like. The actual amount of binder and composite wax particle will vary depending on the types of applications.

The polymeric binders useful for the present invention may include reactive functional groups capable of forming covalent bonds by intermolecular crosslinking or by reaction with a crosslinking agent. Suitable reactive functional groups include: hydroxyl, carboxyl, carbodiimide, epoxide, aziridine, vinyl sulfone, sulfinic acid, active methylene, amino, amide, allyl, and the like. Suitable crosslinking agents that may effectively be used in the coating compositions of the invention including aldehydes, epoxy compounds, polyfunctional aziridines, vinyl sulfones, methoxyalkyl melamines, triazines, polyisocyanates, dioxane derivatives such as dihydroxydioxane, carbodiimides, and the like.

Other additional compounds that can be employed in the auxiliary layer compositions of the invention include matting agents, surfactants, coating aids, inorganic fillers such as non-conductive metal oxide particles, conductive metal oxide particles, antistats, carbon black, magnetic particles, pigments, dyes, biocides, UV and thermal stabilizers, and other addenda well known in the imaging art.

The layer compositions of the present invention may be applied as solvent coating formulations containing up to 20% total solids by coating methods well known in the art. For example, hopper coating, gravure coating, skim pan/air knife coating, spray coating, and other methods may be used with very satisfactory results. The coatings are dried at temperatures up to 150 deg. C. to give dry coating weights of 20 $mg/m^2$ to 10 $g/m^2$.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one greensensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic clement, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are used to illustrate the present invention. However, it should be understood that the invention is not limited to these illustrative examples.

EXAMPLES

Example 1

A stirred reactor containing 382.5 g of deionized water, 27.0 g of 10% by weight Rhone Poulenc Rhodapex CO-436 surfactant, and 240.0 g of 25% by weight of Michemlube 160 (from Michelman Inc.) aqueous carnauba wax dispersion was heated to 80 deg. C. and purged with $N_2$ for 1 hour. After addition of 0.5 g of potassium persulfate, an emulsion containing 102.8 g of deionized water, 84.0 g of isobutyl methacrylate, 30.0 g of styrene, 27.0 g of 10% by weight Rhone Poulenc Rhodapex CO-436 surfactant and 0.25 g of potassium persulfate was slowly added over a period of 1 hour. The reaction was allowed to continue for an additional 2 hours. 0.35 g of benzoyl peroxide in 5 g of toluene was then added to reactor. An emulsion containing 444.0 g of deionized water, 36.0 g of 10% by weight Rhone Poulenc Rhodapex CO-436 surfactant, 96.0 g of isobutyl methacrylate, 24.0 g of methacrylic acid, and 0.15 g of benzoyl peroxide was added continuously for 1 hour. The reaction was allowed to continue for 3 more hours before the reactor was cooled down to room temperature. The latex prepared was filtered through glass fibre to remove any coagulum. The latex so made was mixed with acetone at 1:1 ratio to isolate the polymer particles. The precipitate was washed several times with distilled water to remove any residual surfactants and salts. Final drying was in an oven heated to 50 deg. C. The particles prepared contained about 60% by weight core portion and 40% by weight shell portion and the wax content was 20% by weight of the polymer particles. The core portion polymer composition was 70% by weight isobutyl methacrylate and 30% by weight styrene. The shell portion polymer composition was 80% by weight isobutyl methacrylate and 20% by weight methacrylic acid. The polymer particle is designated as Com-1.

A stirred reactor containing 480 g of 25% by weight of Michemlube 160 (from Michelman Inc.) aqueous carnauba wax dispersion was heated to 80 deg. C. and purged with $N_2$ for 1 hour. After addition of 0.3 g of benzoyl peroxide in 10 g toluene, an emulsion containing 48 g of deionized water, 43.2 g of methyl methacrylate, 2.4 g of ethylene glycol dimethacrylate, 2.4 g of allyl methacrylate, 14.4 g of 10% by weight Triton X100 surfactant, 4 g of a 10% by weight sodium dodecyl sulfonate surfactant, and 0.1 g of benzoyl peroxide was slowly added over a period of 1 hour. The reaction was allowed to continue for an additional 2 hours. 0.2 g of benzoyl peroxide in 10 g of toluene was then added to reactor. An emulsion containing 72.0 g of deionized water, 61.2 g of methyl methacrylate, 10.8 g of methacrylic acid, 21.6 g of 10% by weight Triton X100 surfactant, 6 g of a 10% by weight sodium dodecyl sulfonate surfactant, and 0.15 g of benzoyl peroxide was slowly added over a period of 1 hour. The reaction was allowed to continue for 3 more hours before the reactor was cooled down to room temperature. The latex prepared was filtered through glass fiber to remove any coagulum. The particles so prepared contain more than 40% by weight of carnauba wax and 50% by weight of polymer phase with the balance being the amount of stabilizers/dispersants used. The particle is designated as Com-2.

Example 2

Preparation of Composite Wax Particle of the Invention

A stirred reactor containing 438.3 g of Michemlube 160 (25% solids, from Michelman, Inc.) was heated to 85° C. and purged with $N_2$ for 2 hour. 0.365 g of azobisisobutyronitrile in 10 g of toluene was then added to the reactor. An emulsion containing 109.6 g of deionized water, 32.9 g of 10% by weight Triton X100 surfactant, 9.1 g of a 10% by weight sodium dodecyl sulfonate surfactant, 87.7 g of methyl methacrylate, 21.9 g of vinyl pyrrolidone, and 0.18 g of azobisisobutyronitrile was added continuously for 2 hours. The reaction was allowed to continue for 4 more hours before the reactor was cooled down to room temperature. The composite wax particle dispersion prepared was filtered through glass fiber to remove any coagulum.

The resultant composite wax particle dispersion has a solid of about 31%. The particle contains about more than 40% by weight of carnauba wax, about 50% by weight of poly(methyl methacrylate-co-vinyl pyrrolidone) (MMA/VP 80/20) with the balance being the amount of stabilizers/dispersants used. The composite wax particle is designated as Wax-1.

Composite wax particles Wax-2 to Wax-14 were prepared in a similar manner. Their compositions and other parameters are listed in Table 1.

TABLE 1

| Particle Designation | Wax/ Wax Particle | Copolymer Composition | Polymer |
|---|---|---|---|
| Wax-1 | ML160 (130 nm) From Michelman, Inc. | Poly(methyl methacrylate-co-vinyl pyrrolidone) 80/20 | 50/50 |
| Wax-2 | ML160 (130 nm) From Michelman, Inc | Poly(methyl methacrylate-co-vinyl pyrrolidone) 60/40 | 50/50 |
| Wax-3 | ML160 (130 nm) From Michelman, Inc | Poly(methyl methacrylate-co-vinyl pyrrolidone) 90/10 | 50/50 |
| Wax-4 | ML160 (130 nm) From Michelman, Inc | Poly(methyl methacrylate-co-vinyl pyrrolidone) 95/5 | 50/50 |
| Wax-5 | ML160 (130 nm) From Michelman, Inc | Poly(methyl methacrylate-co-hydroxyethyl methacrylate) 87.5/12.5 | 50/50 |
| Wax-6 | ML160 (130 nm) From Michelman, Inc | Poly(methyl methacrylate-co-N,N-dimethyl acrylamide) 90/10 | 50/50 |
| Wax-7 | ML160 (130 nm) From Michelman, Inc | Poly(methyl methacrylate-co-2-vinylpyridine) 90/10 | 50/50 |
| Wax-8 | ML160 (130 nm) From Michelman, Inc | Poly(methyl methacrylate-co-poly(ethylene glycol) methacrylate Mn = 360) 85/15 | 50/50 |
| Wax-9 | ML160 (130 nm) From Michelman, Inc | Poly(methyl methacrylate-co-methacrylic acid) 85/15 | 50/50 |
| Wax-10 | ML160 (130 nm) From Michelman, Inc | Poly(ethyl methacrylate-co-merhacrylic acid) 85/15 | 50/50 |
| Wax-11 | ML160 (130 nm) From Michelman, Inc | Poly(butyl methacrylate-co-methacrylic acid) 85/15 | 50/50 |
| Wax-12 | ME 48040 (300 nm) From Michelman | Poly(isobutyl methacrylate-co-methacrylic acid) 85/15 | 50/50 |
| Wax-13 | ME 48040 From Michelman | Poly(ethyl methacrylate-co-methacrylic acid) 85/15 | 50/50 |
| Wax-14 | ML160 (130 nm) From Michelman, Inc. | Poly(methyl methacrylate-co-vinyl pyrrolidone) 80/20 | 65/35 |

Example 3

This example shows that coating compositions comprising the composite wax particles of the invention provide transparent films with excellent frictional characteristics (i.e., low coefficient of friction values) even when incorporated at extremely low levels. A surface lubricant layer was prepared from coating composition consisting of Wax-1 to Wax-7, respectively, in an acetone/methanol solvent mixture. The coating compositions had excellent solution stability and gave transparent, dry surface lubricant layers when applied onto a cellulose acetate substrate at a dry coverage of 50 mg/mr$^2$. The coefficient of friction as measured by the method set forth in ANSI IT9.4-1992 is about 0.1 or less.

A comparative surface layer was prepared by using Com-1 on cellulose acetate support at a dry coverage of about 800 mg/m$^2$. The coefficient of friction as measured by the method set forth in ANSI IT 9.4-1992 is about 0.15.

Wax loaded core/shell particle Com-2 was not dispersible in organic solvent and therefore a surface layer could not be prepared.

This example shows that the composite wax particles of this invention are superior to the lubricant impregnated polymer particles described in U.S. Pat. No. 5,695,919, and capable of providing imaging elements with a coated layer with superior surface lubricity at extremely low dry coverage.

Example 4

Coating compositions were prepared, respectively, from the composite wax particles (Wax-1, Wax-3, Wax-5 to Wax-7, Wax-9) of the invention and a cellulose diacetate binder in an acetone/methanol solvent mixture. Again the coating solutions had excellent stability and gave transparent, dried layers when applied onto a cellulose acetate substrate. The total coating dry coverage was about 360 mg/m$^2$ and the dry coverage of the composite wax particles was about 70 mg/mr$^2$. The coefficient of friction as measured by the method set forth in ANSI IT 9.4-1992 is about 0.15.

The invention has been described in detail with particular reference to certain preferred embodiments thereof, but it will be understood that variations and modifications can be effected within the spirit and scope of the invention.

What is claimed is:

1. An imaging element comprising:

a support;

an image forming layer superposed on said support; and at least one layer superposed on said support formed from a non-aqueous coating composition comprising:

a composite wax particle consisting essentially of:

a wax phase comprising;

a wax having a melting point of greater than 30° C. said wax comprising greater than 80% by weight of the wax phase, and a non-crosslinked polymer phase wherein a wax phase to noncrosslinked polymer phase ratio is greater than 30/70 and less than 90/10; and an organic solvent.

2. The imaging element of claim 1 wherein the support comprises polymeric films, papers, or glass.

3. The imaging element of claim 1 wherein the wax particle comprises a mean size smaller than 1 micron.

4. The imaging element of claim 1 wherein the wax phase of the wax particle further comprises dispersants/surfactants or water.

5. The imaging element of claim 1 wherein the wax comprises animal waxes, plant waxes, paraffin waxes, microcrystalline waxes, Fischer-Torpsch waxes, polyethylene waxes or polypropylene waxes.

6. The imaging element of claim 1 wherein the non-crosslinked polymer phase is prepared from monomers comprising acrylic monomers, alkyl esters of acrylic monomers, hydroxyalkyl esters of acrylic acids, nitrites of acrlic acids, amides of acrylic acids, vinyl acetate, poly (ethylene glycol)(meth)acrylates, N-vinyl-2-pyrrolidone, vinylimidazole, vinyl propionate, vinylidene chloride, vinyl chloride, vinyl aromatic compounds, dialkyl maleates, dialkyl itaconates, dialkyl methylene malonates, isoprene or butadiene.

7. The imaging element of claim 1 wherein the organic solvent comprises acetone, methyl ethyl ketone, methanol, ethanol, butanol, propyl acetate, dowanol PM, iso-propanol, propanol, toluene, xylene, methyl isobutyl ketone or methylene chloride.

8. The imaging element of claim 1 wherein the at least one layer further comprises binders.

9. The imaging element of claim 8 wherein the binder comprise polyesters, polyamides, polyurethanes, cellulose derivatives, polyacrylates, polycarbonates, polyvinyl acetate, polyvinyl butyral, polyvinyl acetal, polystyrene, styrene-butadiene copolymers, epoxy resins, melamine resins, phenolic resins or vinylidene fluoride-containing polymers.

10. The imaging element of claim 1 wherein the at least one layer further comprises matting agents, surfactants, coating aids, inorganic fillers, conductive metal oxide particles, carbon black, magnetic particles, pigments, dyes, biocides, antistatic agents, UV stabilizers or thermal stabilizers.

11. The imaging element of claim 1 wherein the imaging layer comprises a photographic emulsion layer.

* * * * *